US007085512B2

(12) United States Patent
Fan et al.

(10) Patent No.: US 7,085,512 B2
(45) Date of Patent: Aug. 1, 2006

(54) COMPACT CONTAMINATION REDUCING MULTI-CORONA SYSTEM AND METHOD FOR REDUCING CONTAMINATION OF SURFACES BEING ACTED UPON BY CORONA GENERATING DEVICES

(75) Inventors: Fa-Gung Fan, Fairport, NY (US); John R. Lambie, Ontario, NY (US); Moritz P. Wagner, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/980,331

(22) Filed: Nov. 4, 2004

(65) Prior Publication Data

US 2006/0093393 A1 May 4, 2006

(51) Int. Cl.
*G03G 21/20* (2006.01)
*G03G 15/02* (2006.01)

(52) U.S. Cl. ..... 399/93; 399/172

(58) Field of Classification Search ..... 399/100
See application file for complete search history.

(56) References Cited

U.S. PATENT DOCUMENTS 4,025,180 A 5/1977 Kurita et al.
4,725,731 A 2/1988 Lang
4,922,303 A * 5/1990 Takeda et al. ..... 399/92
5,170,211 A 12/1992 Haupt et al.
5,365,324 A * 11/1994 Gu et al. ..... 399/299
5,479,014 A 12/1995 Francois
5,612,768 A 3/1997 Kim et al.
5,835,838 A 11/1998 Yu
5,938,818 A 8/1999 Miller
6,275,670 B1 8/2001 Cho et al.
6,397,024 B1 5/2002 Rejewski et al.
6,678,486 B1 1/2004 Amering et al.
6,944,413 B1 * 9/2005 Maeda ..... 399/92
2001/0010767 A1 8/2001 Watanabe
2001/0026702 A1 10/2001 Nanjo

* cited by examiner

*Primary Examiner*—Quana Grainger
(74) *Attorney, Agent, or Firm*—Oliff & Berridge, PLC

(57) ABSTRACT

Apparatus and methods reduce, and preferably prevent, contamination of a surface or component to be charged or acted upon by a corona generating device. When a voltage is applied to the corona generating device, corona winds having a plurality of corona vortices are formed. Air is pulled via at least one drawing port of the corona generating device. At least one substantially continuous air curtain is formed along a side of the corona generating device when air is pulled via the drawing port of the corona generating device. The formation of the continuous air curtain is not dependent on air being pushed into the corona generating device. Preferably the substantially continuous air curtain extends from substantially one end of the corona generating device, at least a distance equivalent to a greatest continuous total length of the plurality of corona vortices and any portion of the corona generating device situated therebetween.

27 Claims, 15 Drawing Sheets

COMPACT CONTAMINATION REDUCING MULTI-CORONA SYSTEM AND METHOD FOR REDUCING CONTAMINATION OF SURFACES BEING ACTED UPON BY CORONA GENERATING DEVICES

BACKGROUND

1. Field

Exemplary embodiments relate to systems and methods for reducing, and preferably preventing, the contamination of devices and/or surfaces, such as, for example, image forming members, by corona generating devices.

2. Description of Related Art

Corona generating devices include, for example, corona generating wires or corona generating pins which when subjected to a high voltage create an electric field. The strong electric field around the corona generating wires and/or pins causes air to breakdown and cause charges (electrons and/or ions) to flow to another member and/or surface. When a high voltage is applied to the corona generating device and an electric field is formed, undesirable contaminants (such as ozone, NOx, etc.) usually form. The charged corona generating devices also cause corona winds (air flow) to form in the vicinity of the corona generating member, such as, the corona generating wire or the corona generating pin. The formed corona winds may include air streams which flow toward and reach, for example, a surface to be charged. The formed corona winds may also carry other undesirable particles, such as dust, which exist in the vicinity of the corona generating member and/or the corona generating device and/or along the path of the air stream, to that surface. Depending on the type of device employing the corona generating device and/or the purpose of the corona generating device, the deposit of such undesirable particles may cause problems such as, for example, the deterioration of a surface to be charged.

For example, image forming devices, such as printers, facsimile machines, copiers, etc. may employ corona generating devices to charge a surface of an image forming member, such as a photoreceptor on which a latent image of the image to be printed is formed. Typically, during an image forming process, the surface of the photoreceptor is uniformly charged before being exposed to a light beam which selectively discharges the uniform electrostatic charge on the photoreceptor, based on the image data, to form a latent image from the image data. The photoreceptor may, for example, be uniformly charged via electrical charges generated by an electric field formed by a corona generating device. The latent image is then developed by bringing a developer (e.g., toner) into contact with the formed latent image. The developed image is then transferred to a recording medium, such as, for example, a sheet of paper or plastic. The transferred image is then fixed to the recording medium, for example, by a fuser, and/or subjected to further processing.

Corona generating devices can be employed during various operations performed within the image forming devices. For example, corona generating devices can be used to charge the photoreceptor, to transfer the formed toner image from the photoreceptor to the recording medium and/or to pre-clean the photoreceptor of residual toner that might remain on the photoreceptor after transfer of the toner image to the recording medium, etc.

However, contamination of the member exposed to the corona winds (air flow) and any contaminants carried therewith can cause problems, such as, for example, lateral charge migration (LCM) and photoreceptor cracking. Such problems are even more pronounced in an VOC-contaminated environment (VOC, volatile organic compounds) and/or in devices, such as image forming devices, which employ multiple corona generating devices. That is, the more corona generating devices provided in the image forming device, the more undesirable particles will be deposited on the photoreceptor, for example.

It is known for image forming devices to employ an air flow management mechanism to reduce ozone and dirt contamination of the surface to be charged. For example, U.S. Pat. No. 6,397,024 discloses the use of deflector plates to divert contaminated air flow streams away from the corona charger. However, while such conventional air flow management mechanisms may reduce ozone emission and dirt deposits on the surface to be charged, they do not prevent and/or substantially reduce corona effluents from contaminating the surface to be charged.

U.S. Pat. No. 6,678,486 discloses a contamination control apparatus which uses an input air port and an output air port to produce an air current for removing contaminants from the area near the corona generating device. FIG. 8 illustrates the contamination control apparatus, which has a push duct 201, which creates a high velocity air stream that reduces the number of effluents 205 which breach into the air curtain 215. The effluents 205 are removed from the area near the corona generating device by a pull duct 202. As shown in FIG. 8, the push duct 201 and the pull duct 202 are situated along the sidewalls of the corona charger 2 such that the air that is input via the push duct 201 exits with effluents via the pull duct 202 situated across from it along the other side wall of the corona charger 2.

The contamination control apparatus 2 employed in U.S. Pat. No. 6,678,486 requires the use of a push duct 201 and a pull duct 202 to generate an air current 215, which increases the cost and size of the corona generating device. In addition, the push duct and the pull duct must be placed along the side wall, and more particularly, along the end of the side wall of the corona generating device, as shown in FIG. 8. Thus, the size of the corona generating device in the process direction (i.e., along the direction of motion of the photoreceptor) is increased by at least the length of the push and pull ducts along that direction. In devices employing multiple corona devices in series, for example, the overall size the device occupies along the process direction and the cost of the device may be substantially increased and the area of the device assembly exposed to the photoreceptor is not used efficiently because of the push ducts and pull ducts in the side walls of the corona generating devices.

To satisfy the demand for smaller and lower-cost devices, it is desirable to provide a contamination reducing system and method which is smaller in size and cheaper and easier to implement and operate.

SUMMARY

In one exemplary embodiment, an air curtain is formed between a corona generating device and a member to be acted upon by the corona device (e.g., a photoreceptor) based on characteristics of generated corona winds (air flow) and without requiring the use of a push duct, which actively pushes air into the corona device. The air curtain protects the acted upon member by reducing the amount of, and preferably preventing, contaminants that are provided by and/or located in the vicinity of the corona generating member and/or device from being transported to the acted-upon member.

According to another exemplary embodiment, a contamination reduction system and method is provided which only employs a pull (air drawing) duct.

According to another exemplary embodiment, a contamination reduction system and method is provided which only employs a pull duct located along a wall of the device which does not define an adjacent corona generating device and thus, does not elongate an assembly having a plurality of adjacent corona generating devices.

According to another exemplary embodiment, there is provided an image processing apparatus having a photoconductive surface adapted to receive an electrostatic charge from a corona generating device and contamination reduction means. The contamination reduction means reduces contamination of the photoconductive surface by generating an air curtain for reducing the amount of, and preferably preventing, corona wind and effluents generated when a voltage is applied to the corona generating device from reaching a surface of the photoconductive member.

According to another exemplary embodiment, there is provided an apparatus and method for reducing, and preferably preventing, contamination of a surface or component to be charged or acted upon by a corona generating device. When a voltage is applied to the corona generating device, corona winds having a plurality of corona vortices are formed. Air is pulled via at least one drawing port of the corona generating device. At least one continuous air curtain is formed along a side of the corona generating device when air is pulled via the drawing port of the corona generating device based on at least one characteristic of the formed corona winds. The formation of the continuous air curtain is not dependent on air being actively provided to (i.e., actively pushed into) the corona generating device, and the continuous air curtain substantially extends across the open side of the corona generating device(s) facing the surface to be charged and extends from substantially one outer-most end of the corona generating device at least a distance equivalent to a greatest continuous total length of the plurality of corona vortices, and any portion of the corona generating device(s) situated therebetween. The continuous air curtain may be formed of a plurality of air curtains formed in series and traveling in the same or different directions, and each of the corona generating devices may employ a single or multiple corona generating members (e.g., wire or pin).

According to another exemplary embodiment, there is provided a corona generating means and a contamination reducing means. The contamination reducing means is not dependent on air being pushed into the device, and the contamination reducing means generates a continuous air curtain substantially along at least one side of the corona generating means. The contamination reducing means reduces a flow of contaminants from a first area on one side of the continuous air curtain to a second area on another side of the continuous air curtain, wherein the first area comprises the corona generating means.

These and other optional features and possible advantages of various exemplary embodiments are described in, or are apparent from, the following detailed description of exemplary embodiments of systems and methods.

BRIEF DESCRIPTION OF THE DRAWINGS

Exemplary embodiments described herein will be described in detail, with reference to the following figures, in which:

FIGS. 2(*a*) and 2(*b*) are diagrams respectively illustrating the air flow streamlines of the second and third corona devices shown in FIG. 2;

FIGS. 3(*a*), 3(*b*), 3(*c*) and 3(*d*) are velocity vector diagrams respectively illustrating the air flow patterns of the first, second, third and fourth sequentially oriented corona devices;

DETAILED DESCRIPTION OF EXEMPLARY EMBODIMENTS

Throughout the following description, numerous specific structures/steps of some exemplary embodiments are set forth in order to provide a thorough understanding of the exemplary embodiments. It is not necessary to utilize all of these specific structures/steps.

Exemplary embodiments of systems and methods will be described below in relation to the surface of a photoreceptor of an image forming device. However, the exemplary embodiments may also be applied to any surface which can be exposed to contamination as a result of corona emission or effluents. Accordingly, the invention is not limited to the image forming device described below, and the invention may be used in conjunction with any image forming device or other types of devices which employ corona generating devices.

Corona generating devices may be used to generate an electric field and a flow of electrical charges for charging a surface or component that is to be charged. When a high potential is applied to a corona generating device, it generates corona discharge by ionizing surrounding air. In particular, when subjected to a high voltage, coronating wires or pin tips emit electrical charges (i.e., ions, electrons) which fly through the air and toward the counter-electrodes. The fast-moving emitted electrical charges impart a body force on the surrounding air and accordingly, generate corona winds. The air flow pattern of a corona generating device depends on the configuration of the device and the voltage state of the surface or component being charged. Thus, depending on the configuration, the air flow pattern can be quite complex.

Figure 6:
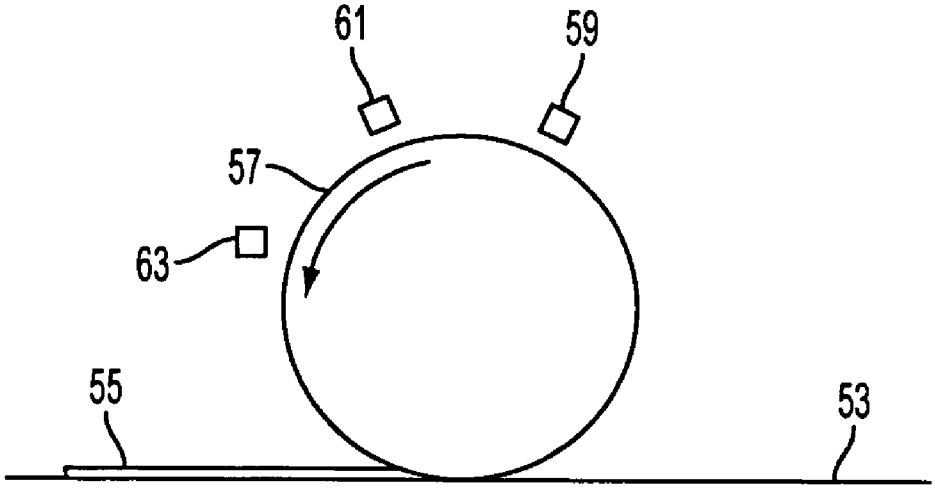
FIG. 6 is a schematic drawing of a portion of an image forming apparatus.

FIG. 6 illustrates a printing section of an exemplary image forming device. The printing section includes a conveyor belt 53, which moves a recording medium (e.g., paper) 55 through the device, an image forming member 57, such as a photoreceptor, which is uniformly charged by a corona generating device 59. The corona generating device 59 may be any corona generating device. The corona generating device 59 may include, for example, any number of corona wires or pins in a single partially defined area or in a plurality of partially defined areas. For example, the corona generating device 59 can be AC or DC corotrons, scorotrons, dicorotrons or discorotrons, etc. A print-head 61 (e.g., scanning laser beam, LED bar) modulates the charge of the photoreceptor 57 based on image data in order to create an electrostatic image on the photoreceptor of the image to be formed. The photoreceptor 57 is then brought into contact with a developer via a developing unit 63 where toner is deposited onto the surface of the photoreceptor 57. The toner adheres to portions of the photoreceptor based on the charged state of each portion. Generally, the developed image formed on the photoreceptor is then transferred to the recording medium 55 via.

While the ionization of air surrounding a corona generating member (wires/pins) generates an electric field for charging the surface to be charged, undesirable effluents, such as ozone ($O_3$) and $NO_x$ also may be generated as a result of the ionization process. Ozone, for example, can irritate and damage materials, such as, rubber, and the combination of $NO_x$ and moisture in the air can form dilute nitric acid. The corona winds tend to transport these effluents to the photoreceptor. If such effluents are deposited on the surface of a photoreceptor of an image forming device, the effluents can physically damage the photoreceptor (e.g., cause cracking) and/or cause image defects (e.g., lateral charge migration (LCM) on the surface of the photoreceptor). For at least these reasons, it is desirable to prevent the corona winds from reaching the surface to be charged.

Some of the effluents may deposit on the corona generating devices themselves. Effluents which deposit on the corona generating devices themselves may cause problems, such as, for example, non-uniform corona discharge which can result, for example, in non-uniform charging of the surface to be charged. Therefore, it is not only desirable to control the corona winds to reduce and preferably prevent the deposit of contaminants on the surface or components to be charged or acted upon, it is also desirable to control the formed corona winds to guide the contaminants which may be carried therewith to a drawing port of the device and away from the corona generating device themselves.

Figure 1:
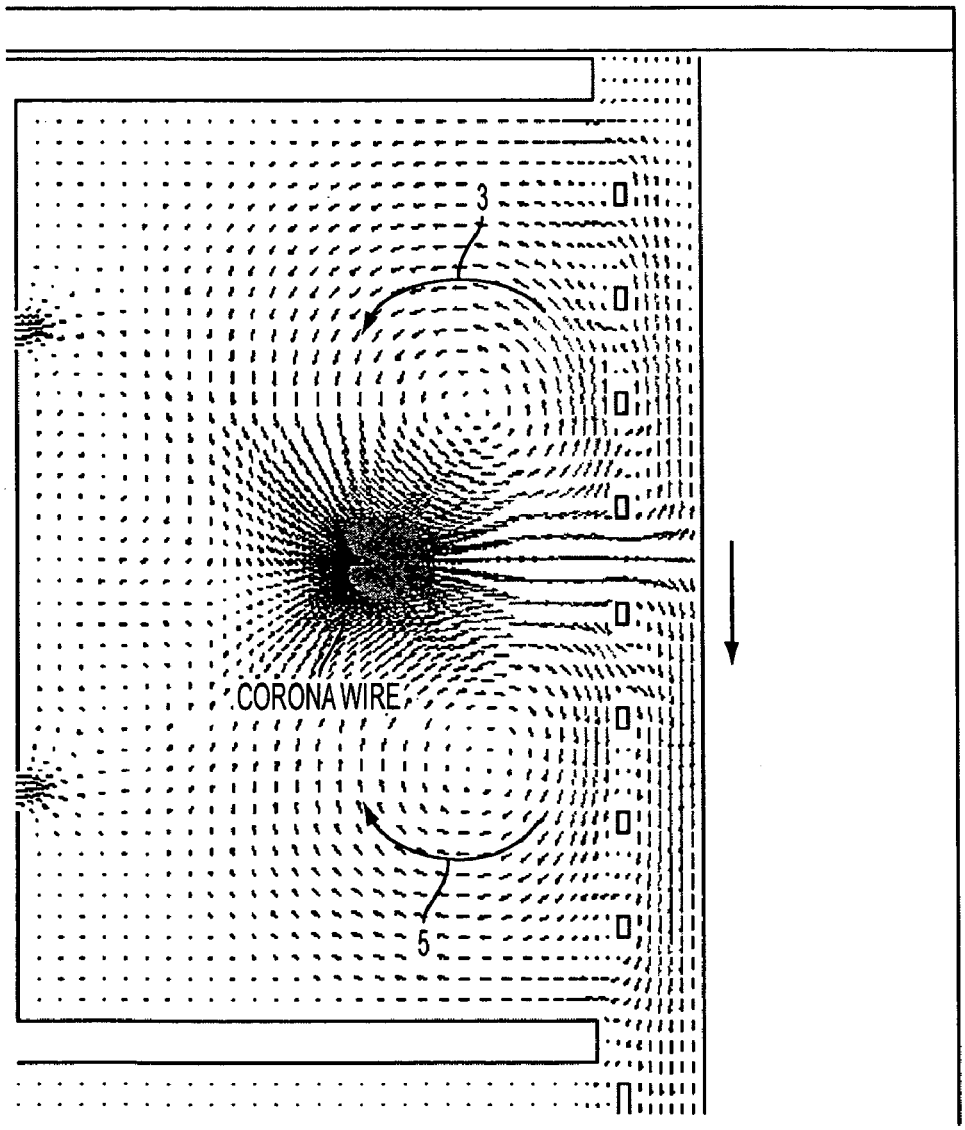
FIG. 1 RELATED ART
FIG. 1 is a diagram of velocity vectors illustrating the air flow pattern in a corona generating device.

FIG. 1 illustrates a typical air flow pattern around a corona wire of a corona generating device that is subjected to a voltage. No air management system is employed in the device illustrated in FIG. 1. As illustrated in FIG. 1, the wire discharge generates a jet stream of air which flows to and reaches the surface to be charged, such as the surface 1 of a photoreceptor of an image forming device. In particular, due to an electrohydrodynamics (EHD) pumping effect, two vortices 3, 5 are formed around the wire. As illustrated in FIG. 1, one vortex 3 is formed above the wire (and circulates in a counter-clockwise direction) and another vortex 5 is formed below the wire (and circulates in a clockwise direction). FIG. 1 also illustrates the streams of air 7 that flow to and reach the surface 1 of the photoreceptor. Such streams of air may carry effluents produced from the ionization process, as well as any pre-existing undesirable particles or contaminants, from around the corona device to the surface 1 to be charged, and allow these undesirable effluents/particles to settle on the surface or component to be charged.

In an apparatus employing multiple corona devices, an air flow pattern, similar to the pattern illustrated in FIG. 1 occurs in each device. Accordingly, the interaction between undesirable effluents/particles and the surface to be charged increases.

Figure 2:
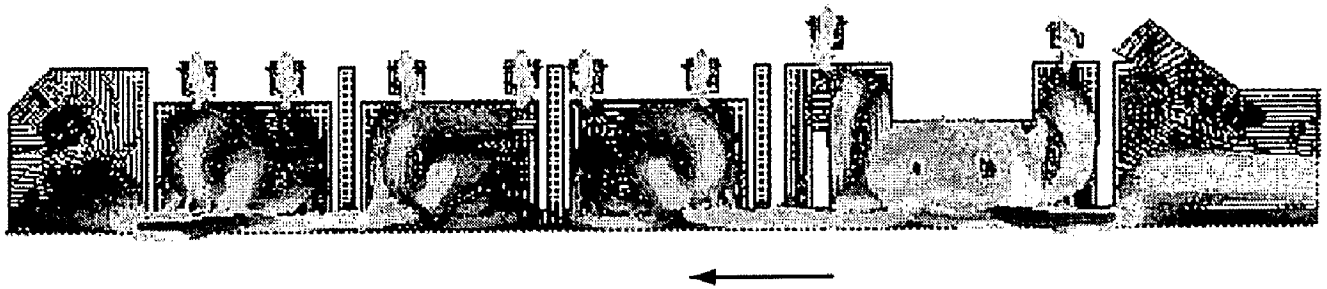
FIG. 2 RELATED ART
FIG. 2 is a diagram of velocity vectors illustrating the air flow pattern in an apparatus with an air flow mechanism which uniformly draws air from each of the drawing/output ports.
Figure 2A:
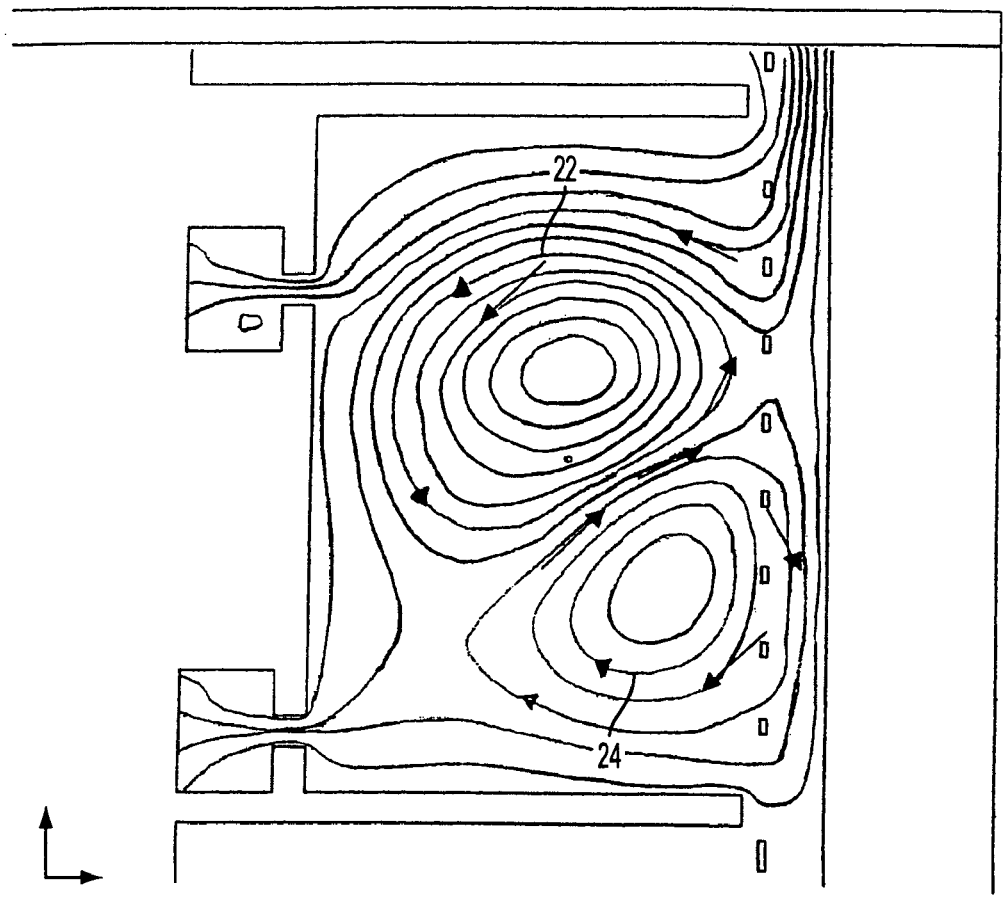
FIG. 2A RELATED ART
Figure 2B:
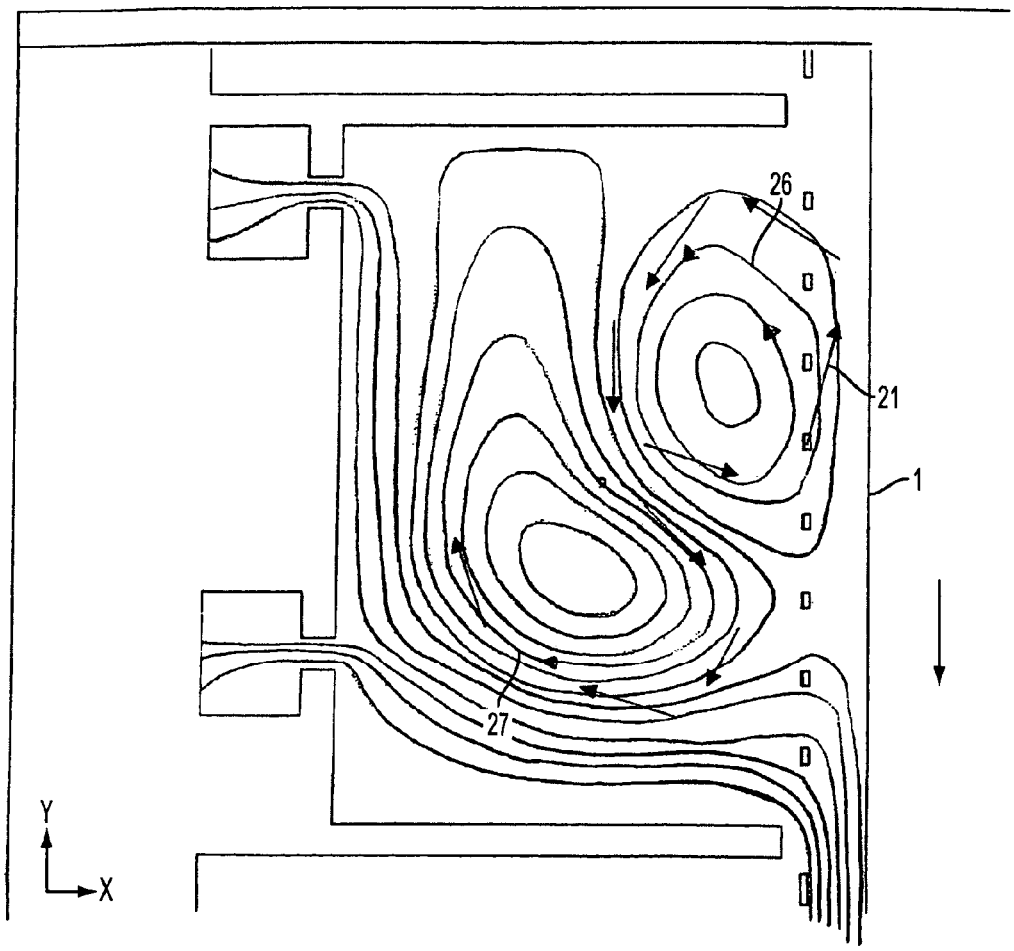
FIG. 2B RELATED ART

FIG. 2 illustrates an air flow pattern in a multi-corona device apparatus with an air flow management mechanism in which air is drawn from all of the output/drawing ports. In the device illustrated in FIG. 2, air is uniformly drawn from the output/drawing ports provided for each of the devices. As discussed below, in the multi-corona device illustrated in FIG. 2, when air is uniformly drawn from all of the output/drawing ports, continuous air curtains are not formed and/or any air curtains formed are not strong enough to block the majority of the corona wind vectors which travel towards the surface or component to be charged or acted upon by the corona generating device.

FIGS. 2(*a*) and 2(*b*) more clearly illustrate the air flow streamlines of the second and third devices of the four corona device apparatus shown in FIG. 2. Each of the corona vortices in each of the devices acts like a conveyer belt that transports undesirable corona effluents/particles from around the corona wire or corona pin to the surface to be charged. For example, vectors 20 and 21 of the second and third devices, respectively, which flow towards the surface 1 of the photoreceptor can carry any undesirable corona effluents/particles in their vicinity to the surface 1 of the photoreceptor. In addition, the circulating air flow patterns 22, 24, 26 and 27 further aggravate the contamination problem because the average speed of the circulating air flow streams of the apparatus illustrated in FIG. 2 is generally low, and thus, the undesirable effluents/particles are prevented (or at least delayed) from being lifted off the surface once they are deposited.

As a result, instead of removing the contaminants from the surface, the circulating flow patterns generally trap the undesirable effluents/particles in the circulation and to have a longer residence time. As shown in FIGS. 2(*a*) and 2(*b*), circulating airflow patterns 22 and 26 rotate substantially counter-clockwise, while circulating airflow patterns 24 and 27 rotate substantially clockwise. Thus, further to the discussion of FIG. 1, in the apparatus illustrated in FIG. 2, each of the second and third corona generating devices includes one circulating airflow pattern which rotates substantially counter-clockwise and one circulating airflow pattern which rotates substantially clockwise.

Figure 3:
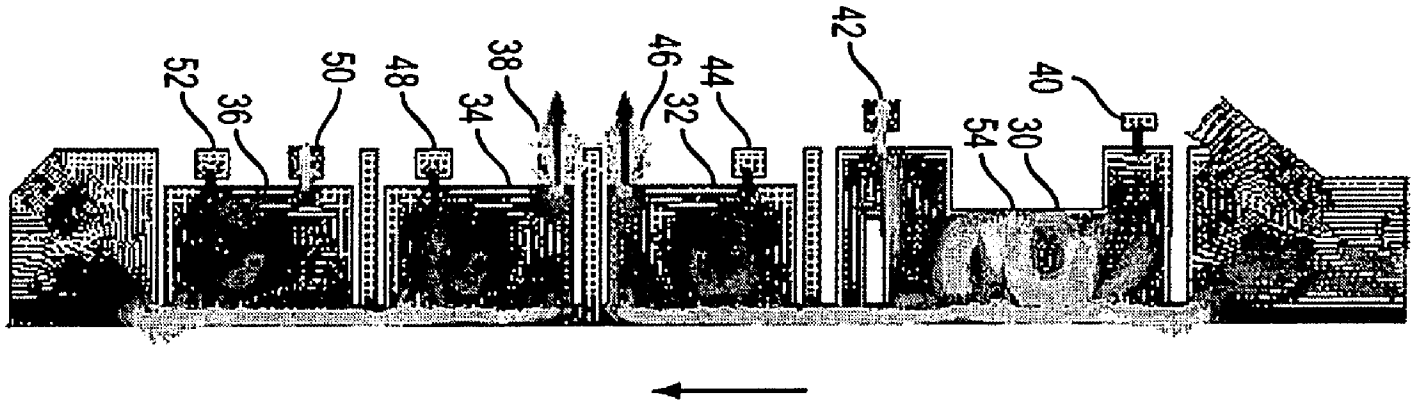
FIG. 3 is a diagram of velocity vectors illustrating the air flow pattern in an exemplary apparatus.
Figure 3A:
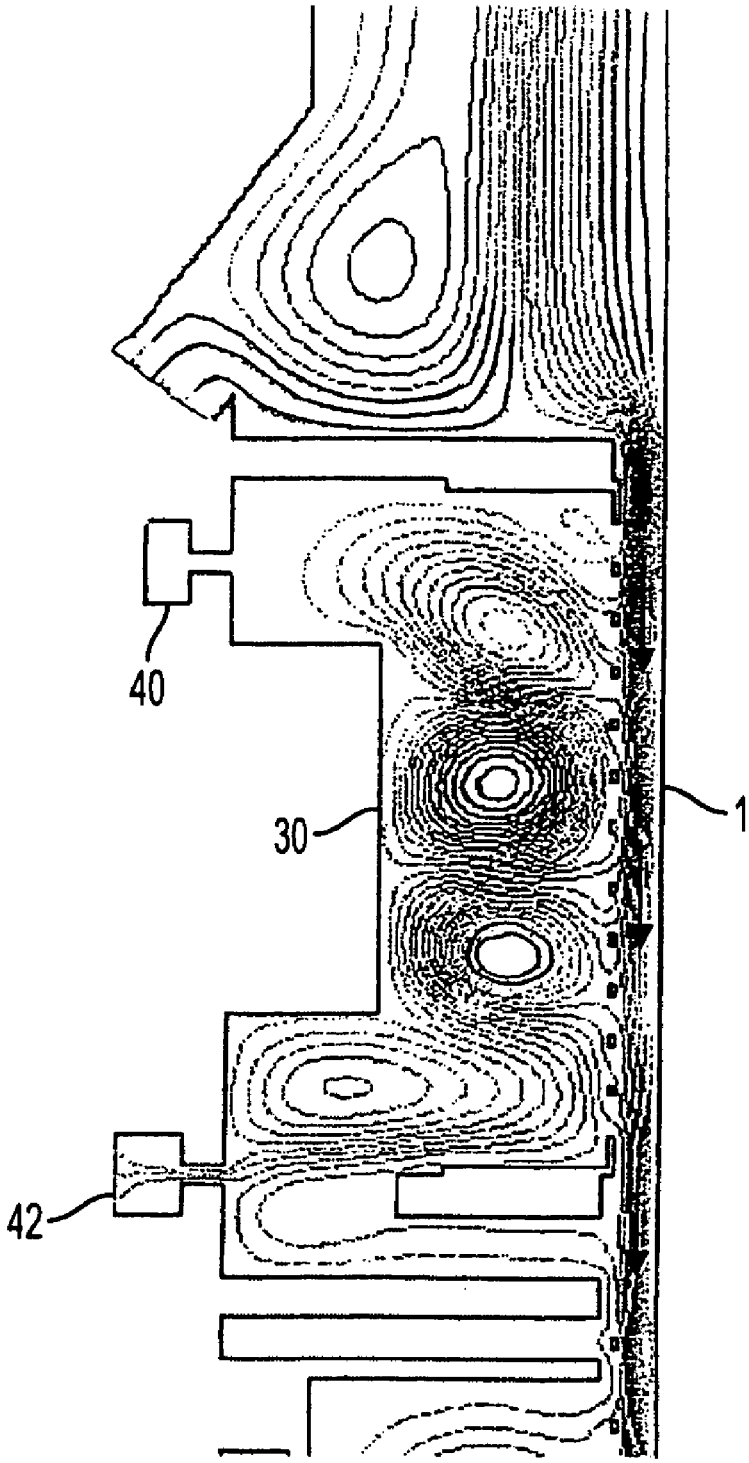
Figure 3B:
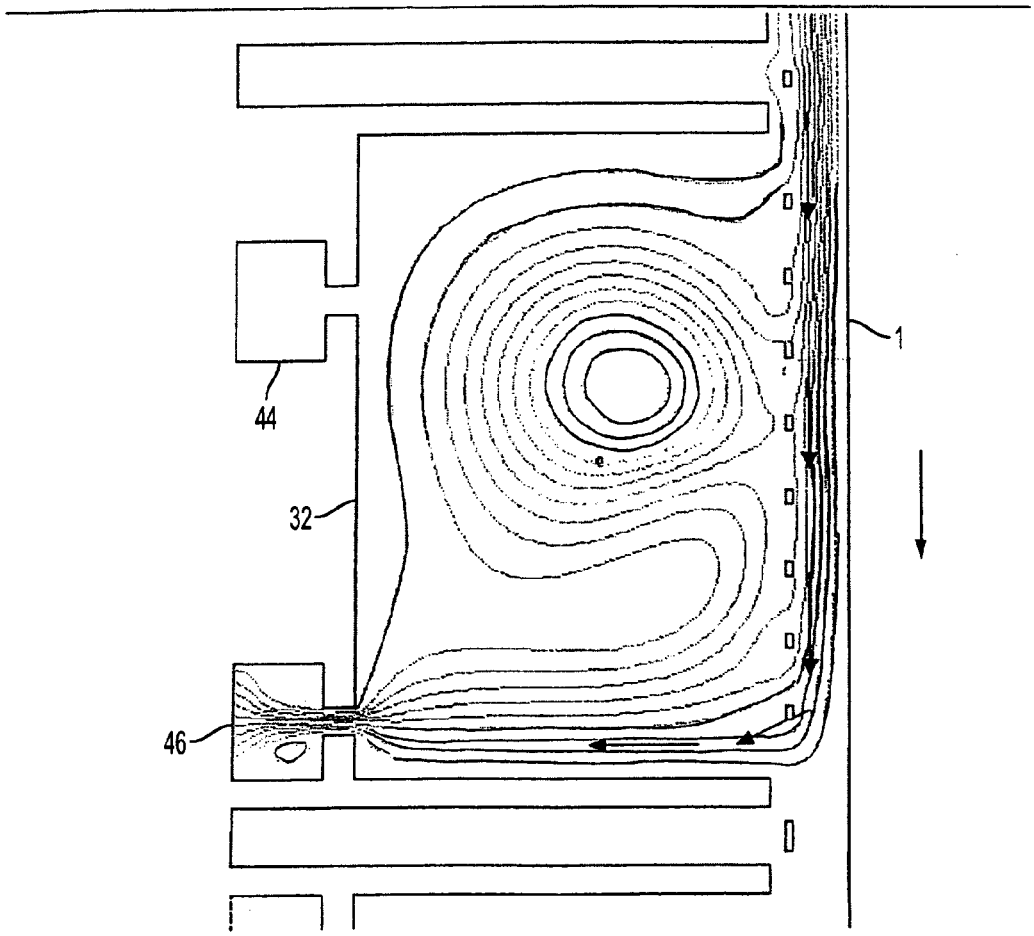
Figure 3C:
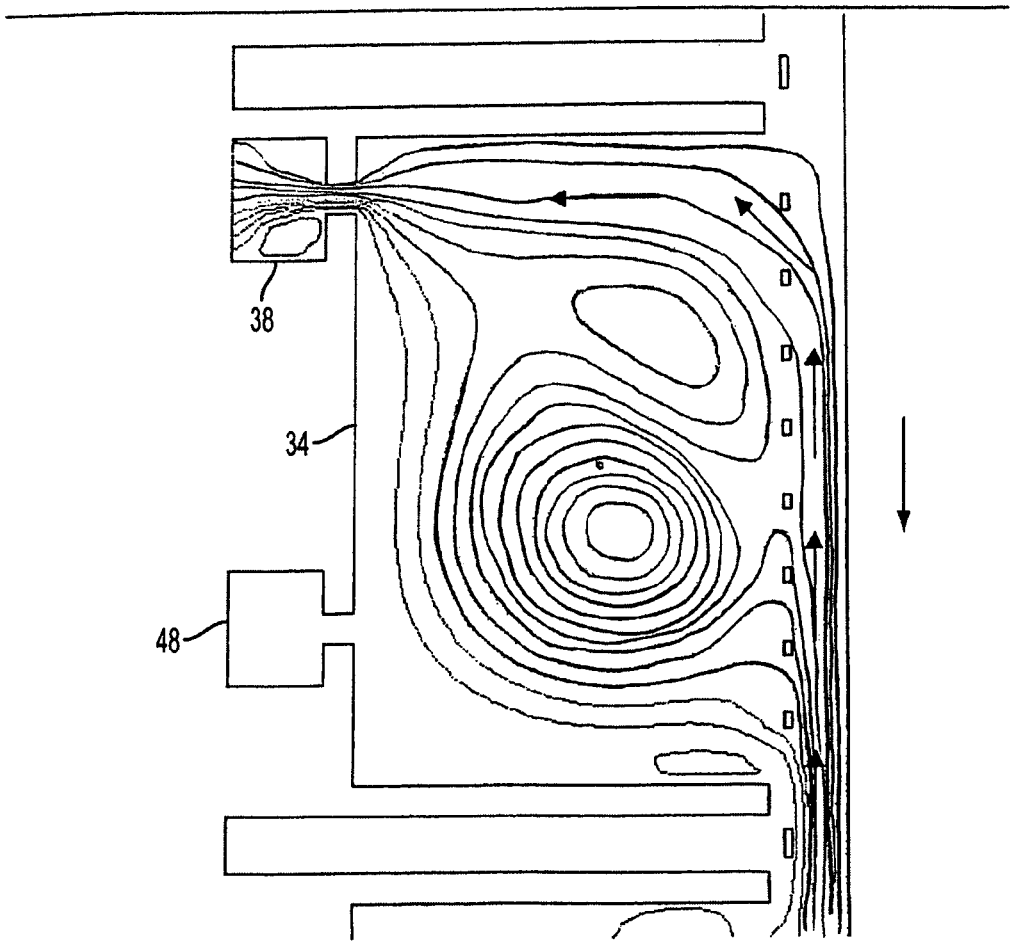
Figure 3D:
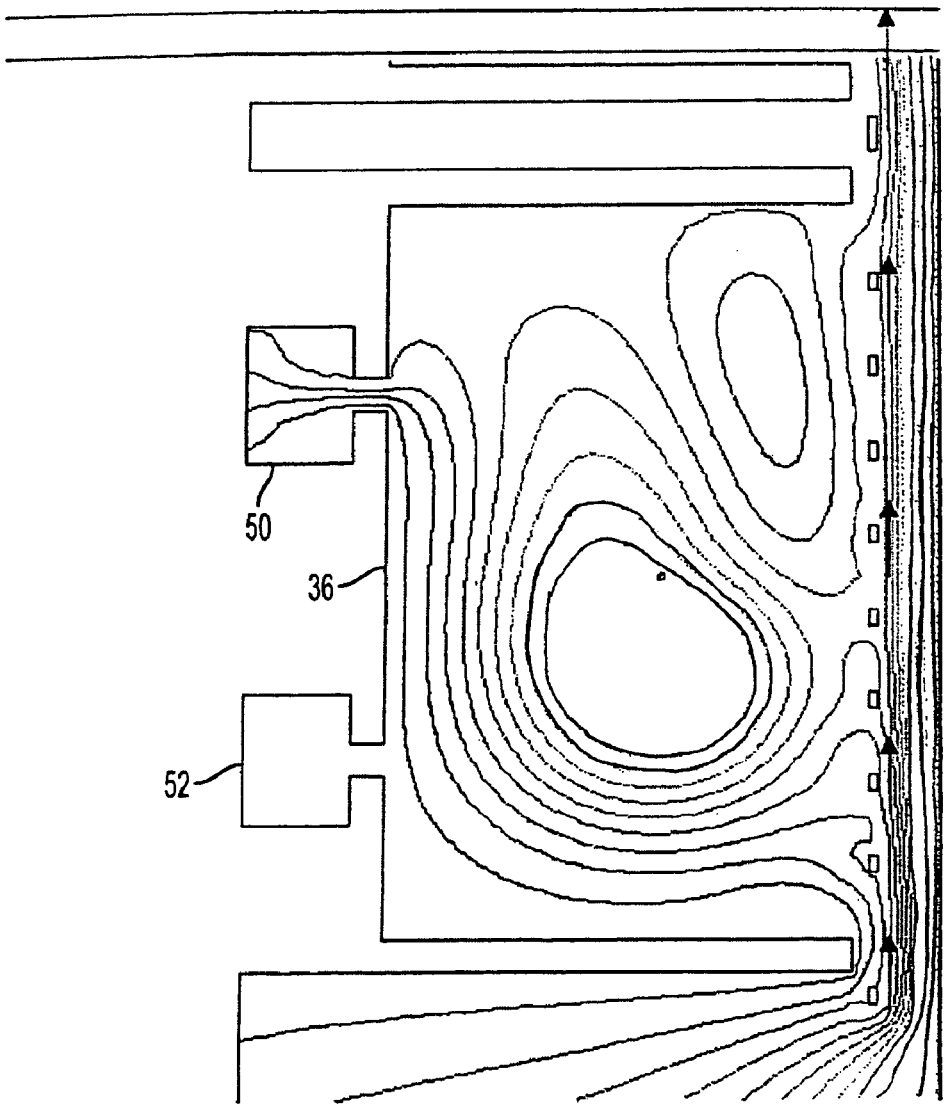

FIGS. 3(*a*)–3(*d*) illustrates continuous air curtains in an exemplary embodiment of an apparatus that practices this invention. The apparatus illustrated employs four corona generating devices. The invention, however, can be practiced in embodiments that employ any number of corona generating devices (including only one). Further, in the exemplary embodiment illustrated in, multiple continuous air curtains are created for reducing, and preferably preventing, the deposit of corona effluents and/or other undesirable particles onto the surface of the photoreceptor. In various implementations of the invention, the combination of drawing/output ports (and the amount of air pulled through the port(s)) may be controlled, to create any number of continuous air curtains along a side of the corona generating device between the corona generating device(s) and the surface(s) and/or component(s) to be charged based on the type and number of generating devices, the characteristics of the devices and the formed corona winds, the characteristics of the surface or member to be charged and the amount of contaminants (including zero contamination) that can be tolerated.

FIGS. 3(*a*)–3(*d*) illustrate the air streamlines of the first-fourth corona devices, respectively. In the exemplary embodiment illustrated, the first corona generating device 30 is a DC operated corona device and the second, third and fourth corona devices 32, 34 and 36 are AC operated corona devices. More particularly, in the exemplary embodiment illustrated, the first corona device 30 contains two corona generating wires/pins, while the second, third and fourth corona devices 32, 34 and 36 each contain a single corona generating wire/pin. Thus, the pattern of the corona winds of the first corona generating device contains additional vortices. As shown in each of FIGS. 3(*a*)–3(*d*), the air flow curtains generated in accordance with this embodiment of the invention serve as walls which block the air flow vectors of the generated corona winds from reaching the surface 1 of the photoreceptor and thereby reduce, and preferably prevent, contamination of the surface 1 by effluents and other undesirable particles.

As illustrated in FIGS. 3(*a*)–3(*d*), the air streamlines of the continuous air curtain separating the first and second corona generating devices from the surface of the photoreceptor flow in the same direction as the direction of motion of the photoreceptor (see arrow in FIG. 3), while the air streamlines of the continuous air curtain separating the third and fourth corona generating devices from the surface of the photoreceptor flow in a direction which is opposite to the direction of motion of the photoreceptor. To form such air curtains, in the embodiment illustrated, air is drawn through at least one of the drawing/output ports 38, 46 which are located along the rear wall of each corona device.

More particularly, each air curtain is created by adjusting the level of the vacuum applied to the respective drawing/output port. For example, in the exemplary embodiment illustrated, the first corona device 30 includes two drawing/output ports 40, 42, the second corona device 32 includes two drawing/output ports 44, 46, the third corona device 34 includes two drawing/output ports 38, 48, and the fourth corona device 36 includes two drawing/output ports 50, 52. However, in the exemplary embodiment illustrated, drawing/output ports 40, 44, 48 and 52 are not utilized, while output ports 42 and 50 are subjected to a vacuum having a lower level than the vacuum level applied to the drawing/output ports 46 and 38 which are situated in the middle.

More particularly, as shown in FIGS. 3(*a*) and 3(*b*) in the exemplary embodiment illustrated therein, an air curtain is generated which extends from beyond the outermost sidewall of the first corona generating device 30 (i.e., the side wall of the first corona generating device which is not adjacent to the second corona generating device 32) substantially all the way to the innermost side wall of the second corona generating device 32 (i.e., the sidewall of the second corona generating device which is adjacent to the third corona generating device 34). Similarly, as shown in FIGS. 3(*c*) and 3(*d*), in the exemplary embodiment illustrated therein, another air curtain is generated which extends from beyond the outermost sidewall of the fourth corona generating device 36 (i.e., the sidewall of the fourth corona generating device which is not adjacent to the third corona generating device) substantially all the way to the innermost side wall of the third corona generating device 34 (i.e., the sidewall of the third corona generating device which is adjacent to the second corona generating device).

Thus, as illustrated in FIGS. 3(*a*)–3(*d*), by adjusting the vacuum level applied to each of the drawing/output ports, the desired continuous air curtain(s) is/are generated. The vacuum level and flow balance calculation and optimization can be done, for example, using a general-purpose commercial Computational Fluid Dynamics (CFD) software on any processing system capable of executing such software. Vacuum levels or flow rates at the active ports can be assigned and the resulting flow structure can be observed in order to determine a flow rate to be employed.

As discussed above, not every available drawing/output port need be utilized in every instance to form the air curtains illustrated and/or desired to reduce and preferably prevent contamination of the surface to be charged or acted upon. Instead, the available drawing/output ports are controlled (as described below), to form at least one air curtain based on the configuration of each corona device, the air flow within each corona device, the speed of the airflow, and the charge state of the surface or member to be charged. Further, in various exemplary embodiments of a corona generating device assembly having multiple corona generating devices, all of the corona generating devices may have at least one drawing/output port, while in other exemplary embodiments of the corona generating device assemblies, some of the corona generating devices have at least one drawing port while other corona generating devices do not have any drawing/output ports.

In the exemplary embodiment illustrated, the drawing/output port of each corona generating device is located along the back (rear) wall of each corona generating device to help keep the size of the corona device assembly to a minimum. However, as discussed below, the drawing/output port also may be located between two adjacent corona generating devices. More particularly, as discussed below, the gap between two adjacent corona generating devices may be used as a drawing/output port. By utilizing the gap(s) between adjacent corona generating devices as the drawing/output port(s), the size of the corona generating device assembly may further be reduced.

In the exemplary embodiment illustrated, each of the continuous air curtains helps reduce, and preferably eliminate, contamination by two corona generating devices. Thus, each air curtain extends across the open side of the adjacent corona generating devices, from substantially one outermost end of the pair of corona generating devices to substantially the other outer-most end of the pair of corona generating devices before flowing the air flows out through the drawing port. In other implementation of the invention, each corona generating device may have an individual air curtain that extends from substantially one end of the corona generating device, at least a distance equivalent to a greatest continuous total length of the plurality of corona vortices and any portion of the corona generating device situated therebetween (i.e., at least substantially all of, and in some implementations the entire distance between, the two sidewalls of the corona generating device.

In the exemplary embodiment illustrated, the corona generating devices are arranged in a line such that all of their open mouth portions open to a same side. In various implementations of the invention having multiple corona generating devices, the corona generating devices may be arranged as necessary. For example, if the surface to be charged is circular, the corona generating devices may be arranged such that the open mouth portions of each of the corona generating devices substantially form a curve around the surface to be charged or acted upon.

Also, as illustrated in various embodiments of the invention, the air curtains are provided outside of the corona device (i.e., outside the area defined by the housing 54 which partially encloses the corona generating device). In the exemplary embodiment illustrated in FIGS. 3(*a*)–3(*d*), the housing 54 is substantially U-shaped, and the corona generating device is at least partially contained between the inner side walls of the housing. More particularly, a continuous air curtain is formed along the open mouth portion of the substantially U-shaped housing so as to cover the open mouth of the housing. In various implementation of the invention, the combination of the continuous air curtain and the housing may define a substantially closed area within which at least a majority of the corona vortices exist. The corona generating device is situated within the defined area.

Figure 4:
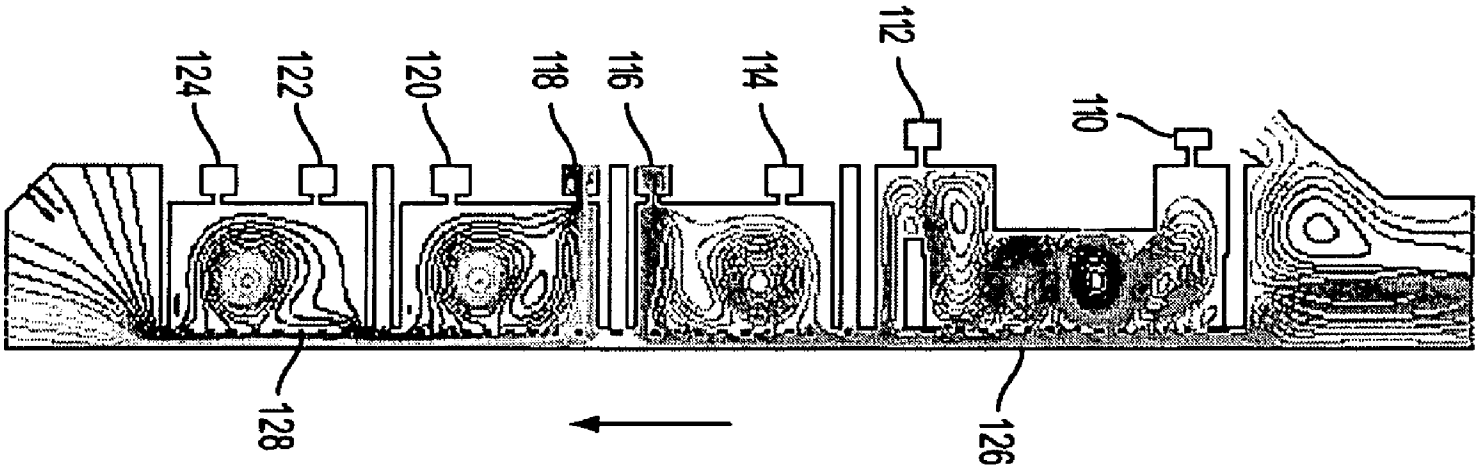
FIG. 4 is a diagram of the air flow patterns of another exemplary apparatus.

FIG. 4 is a diagram of the air flow patterns of another exemplary apparatus according to an exemplary embodiment of the invention. Similar to the exemplary embodiment illustrated, the exemplary embodiment illustrated in FIG. 4 includes four corona generating devices situated in a line such that the open mouth portions of each of the corona generating devices open to the same side. Further, similar to FIGS. 3(*a*)–3(*d*), two continuous air curtains 126 and 128 are formed. In particular, in the exemplary device illustrated in FIG. 4, each corona generating device includes two drawing ports 110, 112, 114, 116, 118, 120, 122 and 124. However, as shown in FIG. 4, in the exemplary embodiment illustrated therein, only drawing ports 116 and 118 are utilized. More particularly, the two innermost drawing ports of the four corona generating devices are the only drawing ports utilized in this exemplary embodiment.

In various exemplary embodiments, a same or different vacuum level may be applied to each of the drawing/output ports in order to generate a continuous air curtain, including one or a plurality of individual air curtains working together, for reducing and preferably preventing contamination of the surface or component to be acted upon or charged.

Figure 5A:
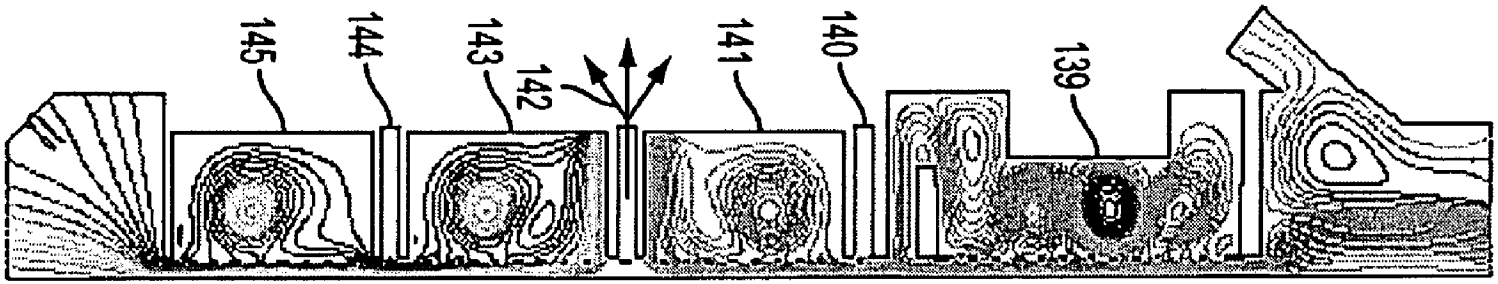
FIGS. 5(*a*) and 5(*b*) are diagrams of the air flow patterns and air flow streamlines, respectively, of another exemplary apparatus.
Figure 5B:
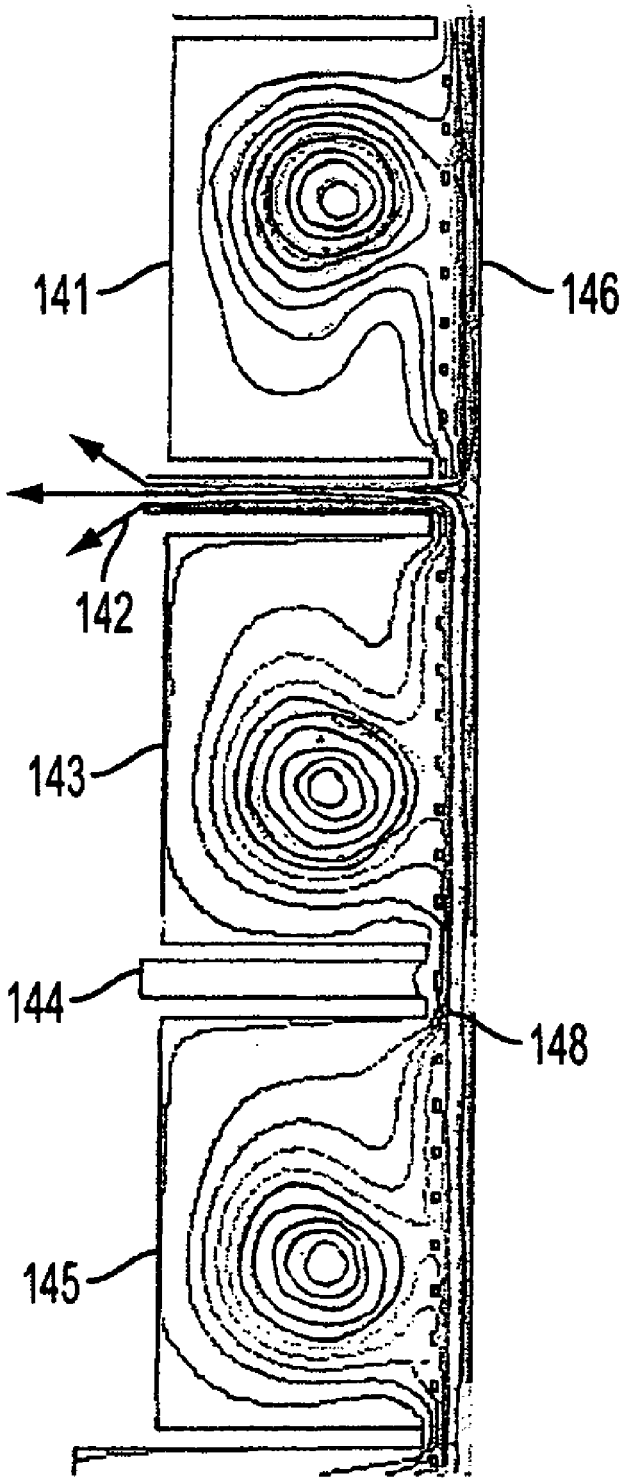

FIGS. 5(*a*) and 5(*b*) illustrates another exemplary embodiment. The device shown in FIGS. 5(*a*) and 5(*b*) utilizes a vacuum in the gap/channel between two adjacent corona generating devices as the drawing/output port. More particularly, FIG. 5(*a*) is a diagram of the air flow patterns of another exemplary apparatus, and FIG. 5(*b*) is a diagram of the air flow streamlines of some of the corona generating devices illustrated in FIG. 5(*a*). The air curtains generated in the device assembly illustrated in FIGS. 5(*a*) and 5(*b*) may be formed when a same or a smaller amount of air (flow rate), than the amount of air drawn from the device assembly illustrated in FIG. 2, is drawn from the device assembly. In the exemplary apparatus shown in FIG. 5(*a*), at least one of the gaps 140, 142, and 144 between the adjacent corona generating devices 139, 141, 143 and 145 may be used for drawing/outputting air and forming the continuous air curtains. FIG. 5(*b*) shows the air flow streamlines when the gap 142 between the second 141 and third 143 corona generating devices is used to pull air to generate the air curtains 146, 148.

Any combination of AC or DC operated corona generating devices may be employed in any of the exemplary embodiments. The exemplary corona generating members may be, for example, any combination of DC and/or AC corotrons, scorotrons, and AC dicorotrons and discorotrons. Further, the corona generating devices may have, for example, one or more corona wires or pins. The corona generating devices may or may not include grids. In circumstances where the surface or component to be charged or acted upon is curved, it is possible to reduce the size of the apparatus by arranging the plurality of corona generating devices such that the open mouth portions of the corona generating devices form a curve substantially corresponding to the shape of the surface or component to be acted upon (i.e., like a lock and key).

Figure 7:
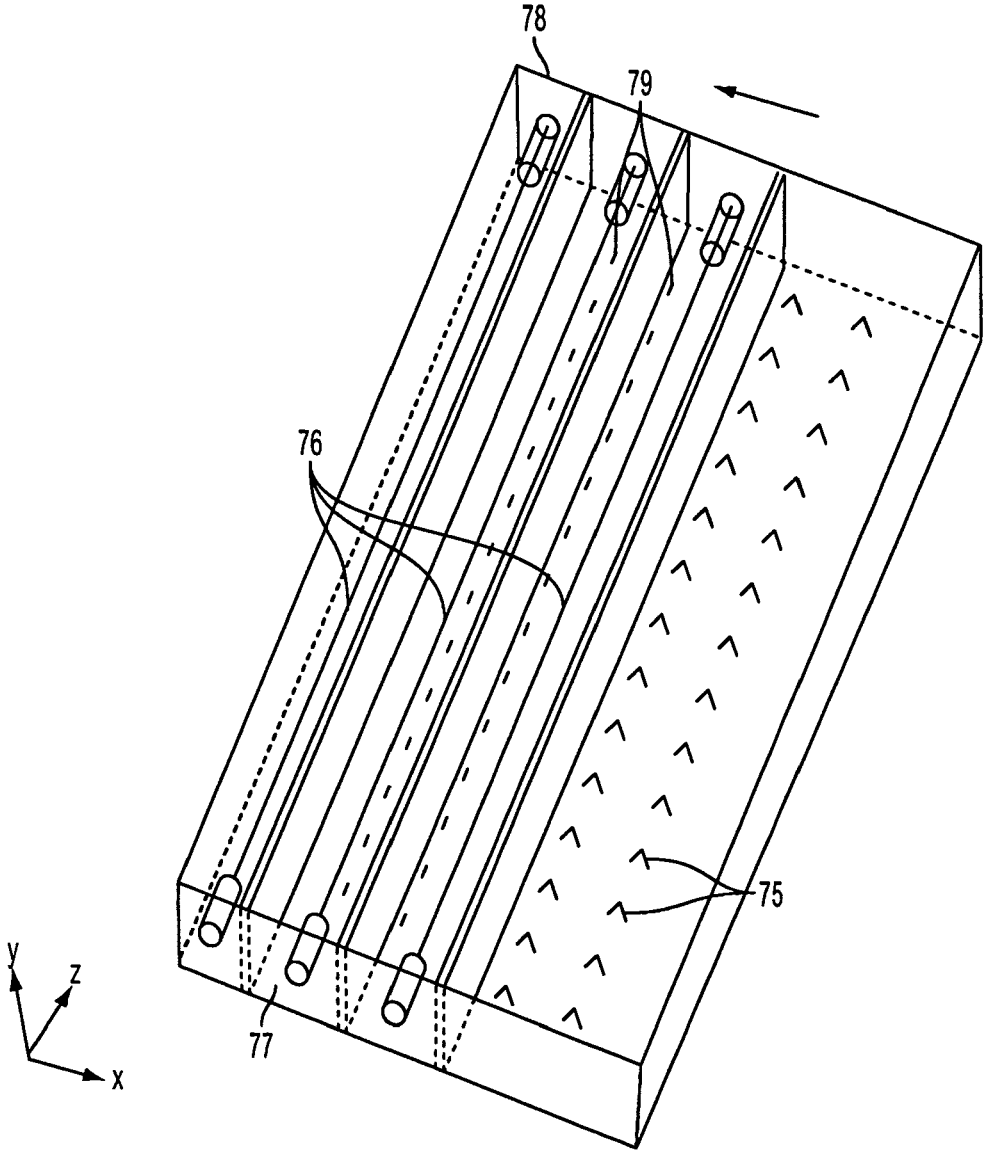
FIG. 7 illustrates a 3-dimensional perspective view of a multi-corona generating device assembly.
Figure 8:
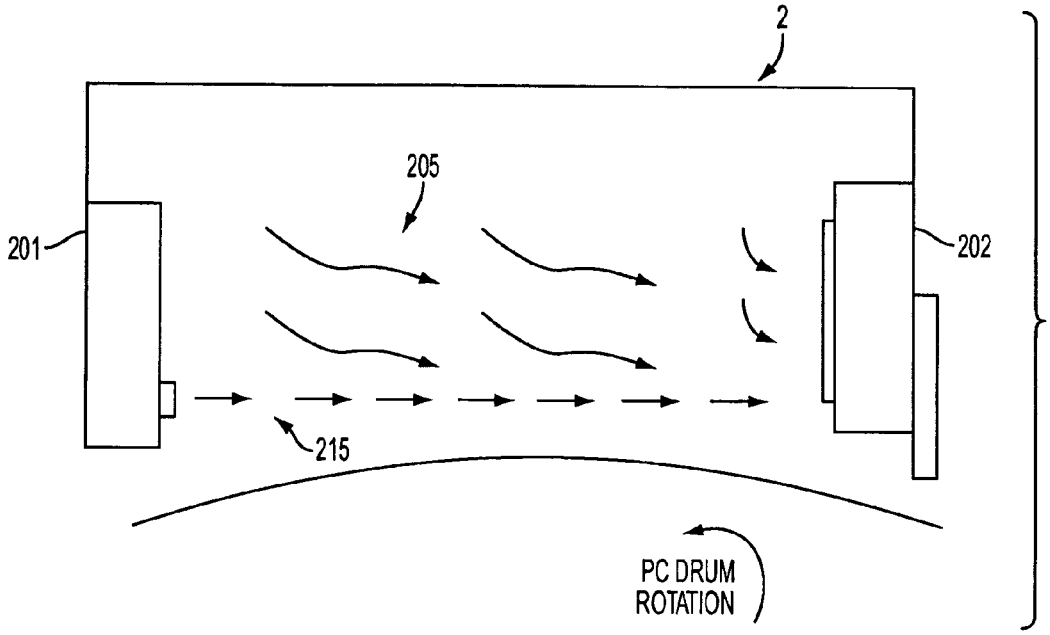
FIG. 8 PRIOR ART
FIG. 8 is a schematic drawing of a known contamination control apparatus for a corona charger.

In addition, as illustrated in FIG. 7, corona generating devices generally have a long 3-D geometry with, for example, corona generating wires 76 or and/or corona generating pins 75 arranged therein. The devices extend, for example, in the z-direction, having gaps 78 therebetween. In order to minimize air movement in the z-direction (i.e., the end effects) and to maintain a 2-dimensional flow pattern in the device, the two ends of the long member/device are generally closed by wall sections 77 that block air flow in the z-direction. Or, alternatively, in an embodiment where a wall section (e.g., 77) is not provided, seals and/or end caps (i.e., plug-like members) may be used. Without closed ends, the air flow patterns in the corona generating devices are substantially 3-dimensional and much more complex. In the exemplary structure of a multi-corona generating device assembly illustrated in FIG. 7, a plurality of holes 79, aligned in series, for example, are provided for the air drawing ports.

In the described exemplary embodiments, air curtains are achieved by strategically positioning the port(s) and configuring the air flow rates through each port. More particularly, the air curtains and the prevention of corona effluents from contaminating the surface to be charged are achieved by strategically positioning and/or strategically utilizing the port(s) in the corona generating device or, in an embodiment with a plurality of corona generating devices, by strategically positioning and/or strategically utilizing the drawing port(s) among the plurality of corona generating devices. To generate a continuous air curtain, the corona winds generated by the corona generating device and/or the air streams that enter a corona generating device, via another corona generating device, for example, are controlled, based on the characteristics of the air flow within each corona generating device and any combination of the available ports, to acquire enough momentum to stay in a continuous form until they exit through the drawing/output port(s).

By controlling the air streams to form a continuous air curtain, the speed and the direction of the air streams at critical locations are generally more optimal than those of the air streams generated in conventional air flow management mechanisms. Due to the generally higher speed of the air streams, the residence time of any contaminants or undesirable particles that are generated in or get into the device(s) is reduced.

In exemplary embodiments, vacuums can be employed upstream and/or downstream of the device assembly to encourage the formation of continuous air curtain(s).

In exemplary embodiments, the drawing/output port may be a slot or a plurality of holes, in series, for example, through which air can be drawn. To keep the size of the corona generating device to a minimum, the drawing port preferably is arranged along a back (rear) wall of the corona generating device. More particularly, to keep the size of the corona generating device to a minimum, the drawing port is arranged along a portion of the corona generating device wall which is not shared with another corona generating device (i.e., an unshared portion of the wall of the corona generating device). For example, the drawing port in exemplary embodiments is arranged along a bottom portion of the U-shaped housing of the corona generating device. More particularly, the bottom portion of the U-shaped housing is the portion of the wall which is substantially parallel to the plane along which the open mouth of the substantially U-shaped housing extends, or the portion of the wall which is substantially parallel to the plane along which the closest portion of the surface to be charged is situated. For example, in the case where the surface to be charged is circular (e.g., a drum) and rotates during the process, the drawing/output port of the corona generating device may be arranged along a surface of the housing which is substantially parallel to the segment of the circular surface which is closest to the corona generating device. In other exemplary embodiments, the drawing/output port may be a channel or gap between the side walls of two adjacent corona generating devices. In other exemplary embodiments, any combination of output ports in the form of slots and/or holes in the back wall or unshared portion of the wall of the corona generating device and output/drawing ports in the form of gaps or channels between two adjacent corona generating devices may be employed.

In various exemplary embodiments, air input ports are not needed, and preferably are not used, and thus the air flow management system is simpler, smaller and more cost effective than conventional air flow management systems. The size of the exemplary embodiments can therefore be minimized in relation to conventional air flow management systems for a multi-corona generating device assembly by positioning the output/drawing port(s) along a back wall or a shared wall of the corona generating device(s).

Systems and methods which, depending on the corona wind pattern generated by each of the corona generating device(s), employ at least one output/drawing port to control the direction and speed of air flow within each device in order to generate a continuous air curtain between each corona generating device and the surface or component to be charged or acted upon may be provided, as discussed above. A vacuum is applied to each drawing port, to generate the continuous air curtain(s). In some exemplary embodiments, different vacuum levels are applied to selective drawing/output ports to appropriately control the continuity and speed of the air streams of the air curtain(s).

The exemplary embodiments of corona generating devices, discussed above, can be included in various imaging forming devices such as, for example, printers, copiers, facsimile machines, multi-function machines that perform two or more of the functions of a printer, copier and facsimile machine, etc.

While the exemplary embodiments have been outlined above, many alternatives, modifications and variations will be apparent to those skilled in the art. Accordingly, the exemplary embodiments as set forth above, are intended to be illustrative and not limiting.

What is claimed is:

1. A device that applies a charge to a member, the device comprising:

at least one corona generating device in which, when a voltage is applied to the at least one corona generating device, corona winds having a plurality of corona vortices are formed; and a contamination reducing device that reduces contamination of the member by forming an air curtain between the member and the corona vortices, the contamination reducing device includes at least one drawing port through which air is drawn from within an internal chamber of the corona generating device, and the contamination reducing device does not include any input ports that push air into the chamber, such that the air curtain is formed without pushing any air into the chamber.

2. The device of claim 1, wherein the at least one corona generating device comprises a housing that defines the chamber.

3. The device of claim 2, wherein the housing is substantially U-shaped and has an opening that is located adjacent to the member to which the charge is applied.

4. The device of claim 2, wherein the housing includes an opening that is located adjacent to the member to which the charge is applied, and the at least one drawing port is located in a rear wall of the housing, the rear wall is located at a portion of the housing that is opposite from the opening.

5. The device of claim 1, wherein the at least one corona generating device comprises at least one of a DC corotron, a DC scorotron, an AC corotron, an AC scorotron, an AC dicorotron and an AC discorotron.

6. The device of claim 1, wherein there are a plurality of the corona generating devices.

7. The device of claim 6, wherein each of the plurality of corona generating devices has a drawing port through which air is drawn, such that an air curtain is formed for each of the plurality of corona generating devices.

8. The device of claim 6, wherein less than all of the plurality of corona generating devices have a drawing port through which air is drawn, such that at least one substantially uninterrupted air curtain is formed for at least two of the plurality of corona generating devices.

9. The device of claim 8, wherein there is a total of two of the corona generating devices, only one of which has the drawing port, such that a single air curtain is formed between the member to which the charge is to be applied and the vortices of both of the two corona generating devices.

10. The device of claim 8, wherein there is a total of four of the corona generating devices, only two of which have the drawing port, such that two air curtains are formed between the member to which the charge is to be applied and the vortices of the four corona generating devices.

11. The device of claim 10, wherein a first one of the two air curtains extends across first and second ones of the four corona generating devices, and a second one of the two air curtains extends across third and fourth ones of the four corona generating devices.

12. A device that applies a charge to a member, the device comprising:

at least one corona generating device in which, when a voltage is applied to the at least one corona generating device, corona winds having a plurality of corona vortices are formed; and a contamination reducing device that reduces contamination of the member by forming at least one air curtain between the member and the corona vortices, the contamination reducing device includes at least one drawing port through which air is drawn, and the contamination reducing device does not include any input ports that push air into the at least one corona generating device, such that the at least one air curtain is formed without pushing any air into the at least one corona generating device.

13. The device of claim 12, wherein the at least one drawing port is located in a wall of a housing that forms a chamber of the at least one corona generating device.

14. The device of claim 12, wherein the at least one drawing port is located adjacent to a wall of a housing that forms a chamber of the at least one corona generating device.

15. The device of claim 14, wherein there are a plurality of the corona generating devices, and the at least one drawing port is located between two of the plurality of corona generating devices.

16. A device that applies a charge to a member, the device comprising:

at least one corona generating device having a housing that defines a chamber, the housing having an opening that is located adjacent to the member to which the charge is to be applied, when a voltage is applied to the at least one corona generating device, corona winds having a plurality of corona vortices are formed in the chamber; and a contamination reducing device that reduces contamination of the member by forming at least one air curtain between the member and the corona vortices, the contamination reducing device includes at least one drawing port through which air is drawn, the at least one drawing port is located in a rear wall of the housing, the rear wall is located at a portion of the housing that is opposite from the opening.

17. The device of claim 16, wherein there are a plurality of the corona generating devices.

18. The device of claim 17, wherein each of the plurality of corona generating devices has a drawing port through which air is drawn, such that an air curtain is formed for each of the plurality of corona generating devices.

19. The device of claim 17, wherein less than all of the plurality of corona generating devices has a drawing port through which air is drawn, such that a single, uninterrupted air curtain is formed for at least two of the plurality of corona generating devices.

20. The device of claim 19, wherein there is a total of two of the corona generating devices, only one of which has the drawing port, such that a single air curtain is formed between the member to which the charge is to be applied and the vortices of both of the two corona generating devices.

21. The device of claim 19, wherein there is a total of four of the corona generating devices, only two of which have the drawing port, such that two air curtains are formed between the member to which the charge is to be applied and the vortices of the four corona generating devices.

22. The device of claim 21, wherein a first one of the two air curtains extends across first and second ones of the four corona generating devices, and a second one of the two air curtains extends across third and fourth ones of the four corona generating devices.

23. A device that applies a charge to a member, the device comprising:

corona generating means for applying a charge to the member, wherein corona winds having a plurality of corona vortices are formed when the corona generating means applies the charge to the member; and contamination reducing means for reducing contamination of the member by forming at least one air curtain between the member and the corona vortices, the contamination reducing means forming the at least one air curtain by drawing air and without pushing any air into the corona generating means.

24. A method of reducing contamination of a member to which a charge is applied, the method comprising:

applying a charge to the member by utilizing at least one corona generating device in which, when a voltage is applied to the at least one corona generating device, corona winds having a plurality of corona vortices are formed; and reducing contamination of the member by forming an air curtain between the member and the corona vortices, the air curtain is formed by drawing air from within an internal chamber of the at least one corona generating device, and without pushing any air into the chamber, such that the air curtain is formed without pushing any air into the chamber.

25. The method of claim 24, wherein the at least one corona generating device comprises a housing that defines the chamber, the chamber has an opening that is located adjacent to the member to which the charge is applied, and the air is drawn from the chamber through at least one drawing port that is located in a rear wall of the housing, the rear wall is located at a portion of the housing that is opposite from the opening.

26. The method of claim 24, wherein there are a plurality of the corona generating devices, and each of the plurality of corona generating devices has a drawing port through which air is drawn, such that an air curtain is formed for each of the plurality of corona generating devices.

27. The method of claim 24, wherein there are a plurality of the corona generating devices, and wherein less than all of the plurality of corona generating devices has a drawing port through which air is drawn, such that a single, uninterrupted air curtain is formed for at least two of the plurality of corona generating devices.

* * * * *